US005196828A

United States Patent [19]

Keniston

[11] Patent Number: 5,196,828

[45] Date of Patent: Mar. 23, 1993

[54] BENDABLE CURRENCY SECURITY DYE PACK

[75] Inventor: Scott E. Keniston, Scottsdale, Ariz.

[73] Assignee: U.S. Currency Protection Corp., Fountain Hills, Ariz.

[21] Appl. No.: 820,367

[22] Filed: Jan. 14, 1992

[51] Int. Cl.[5] ..... G08B 15/02

[52] U.S. Cl. ..... 340/571; 42/1.13; 109/25; 109/29; 109/31; 116/5; 116/71; 116/23; 340/539; 340/568; 340/691; 340/693

[58] Field of Search ..... 340/571, 574, 568, 693, 340/691; 109/31, 29, 25, 36, 38; 42/1.13, 1.08; 116/5, 76, 83, 2, 104

[56] References Cited

U.S. PATENT DOCUMENTS

| | | | |
|---|---|---|---|
| 1,923,979 | 8/1933 | Howett | 109/29 |
| 2,041,577 | 5/1936 | Sutherland | 340/571 |
| 3,303,592 | 2/1967 | Harner | 340/568 |
| 3,424,122 | 1/1969 | De Angelis | 116/2 |
| 3,564,525 | 2/1971 | Robeson et al. | 340/571 |
| 3,781,860 | 12/1973 | Freyling, Jr. | 340/571 |
| 3,828,341 | 8/1974 | Carter, Jr. et al. | 340/571 |
| 4,511,888 | 4/1985 | Bernhardt | 340/571 |
| 4,559,529 | 12/1985 | Bernhardt | 340/571 |
| 4,604,607 | 8/1986 | Sanderford, Jr. et al. | 340/574 |
| 5,059,949 | 10/1991 | Caparoni et al. | 340/571 |

*Primary Examiner*—Glen R. Swann, III

*Attorney, Agent, or Firm*—Cahill, Sutton & Thomas

[57] ABSTRACT

A security dye pack disguised as a bundle of currency for deterring robberies includes a housing formed from a stack of currency bills sewn together and having a hallow chamber formed therein. A substrate disposed within the chamber has a flexible central region through which electrical conductors extend for making electrical interconnections between opposing ends of the substrate. Electrical components are mounted on both sides of the flexible central region to generate an actuating signal upon detecting removal of the security dye pack from the protected premises. Canisters containing dye or other active chemicals are secured at opposing ends of the substrate to emit dyed or other active chemicals in opposing directions when expended. The flexible central region of the substrate allows the security dye pack to be bent into a U-shape. Batteries are arranged in a side-by-side relationship in an elongated narrow case to facilitate bending of the security dye pack.

21 Claims, 3 Drawing Sheets

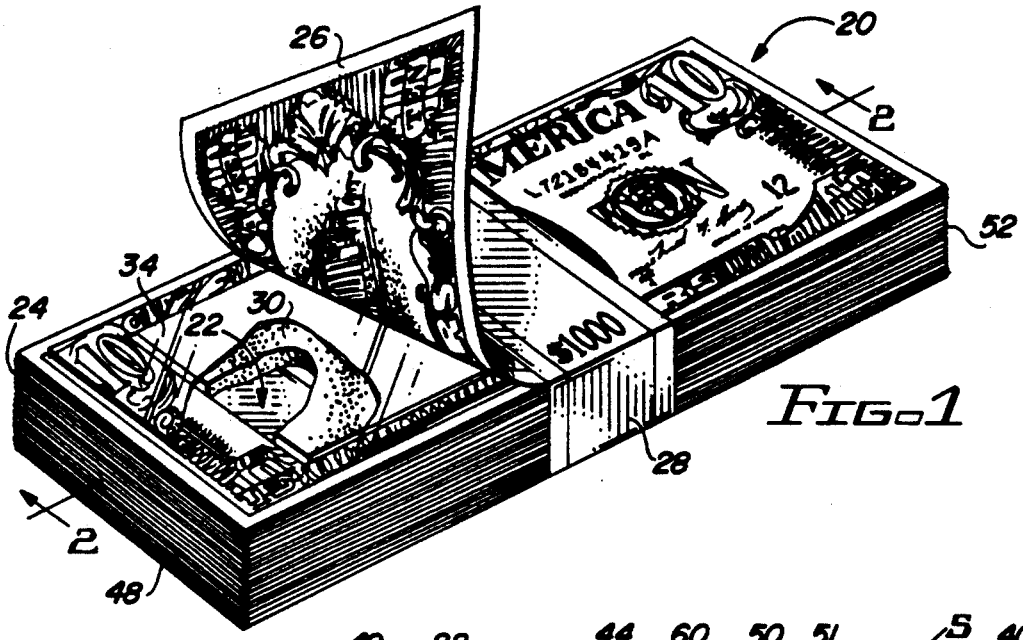
FIG. 1
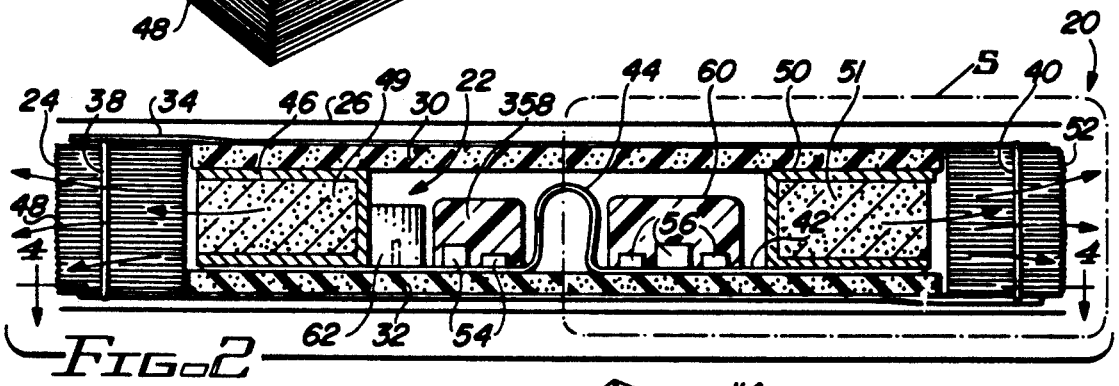
FIG. 2
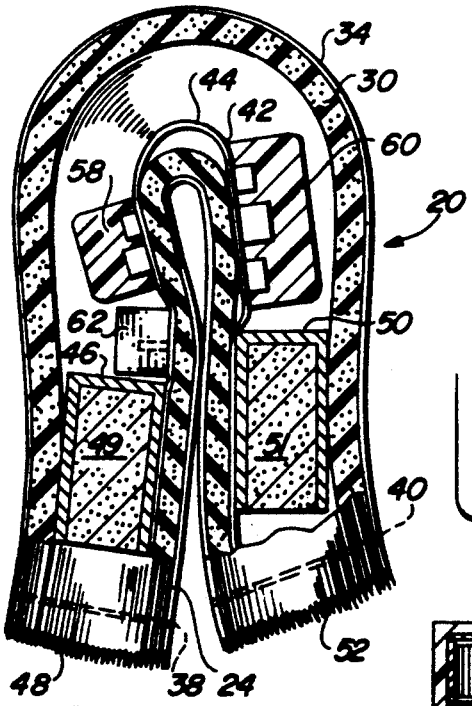
FIG. 3
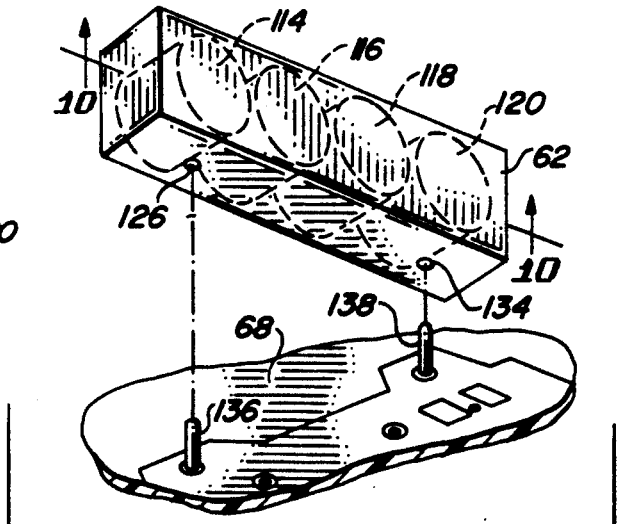
FIG. 9
FIG. 10
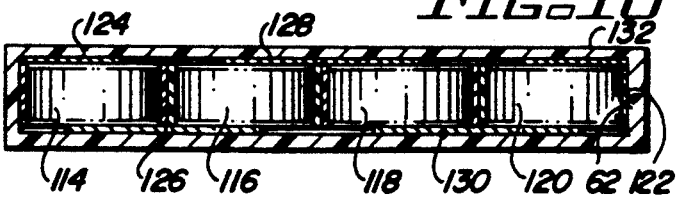

FIG. 4
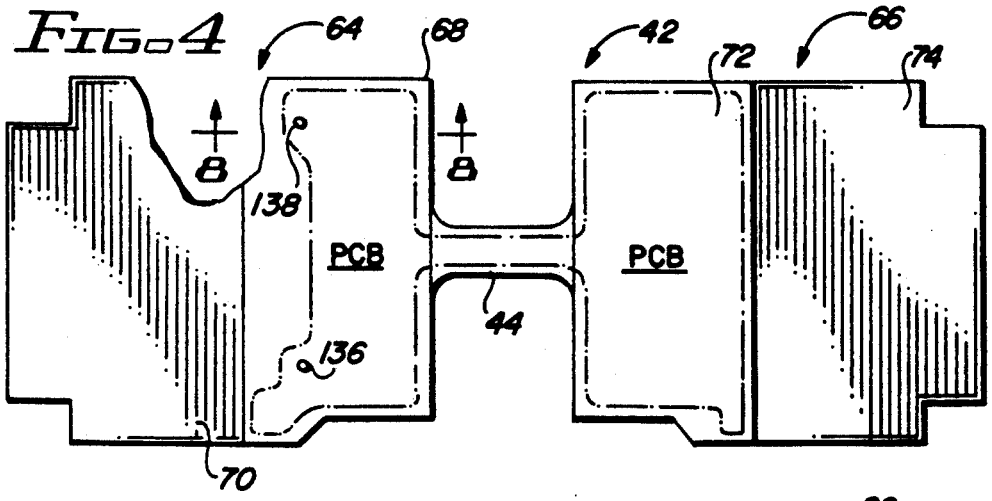
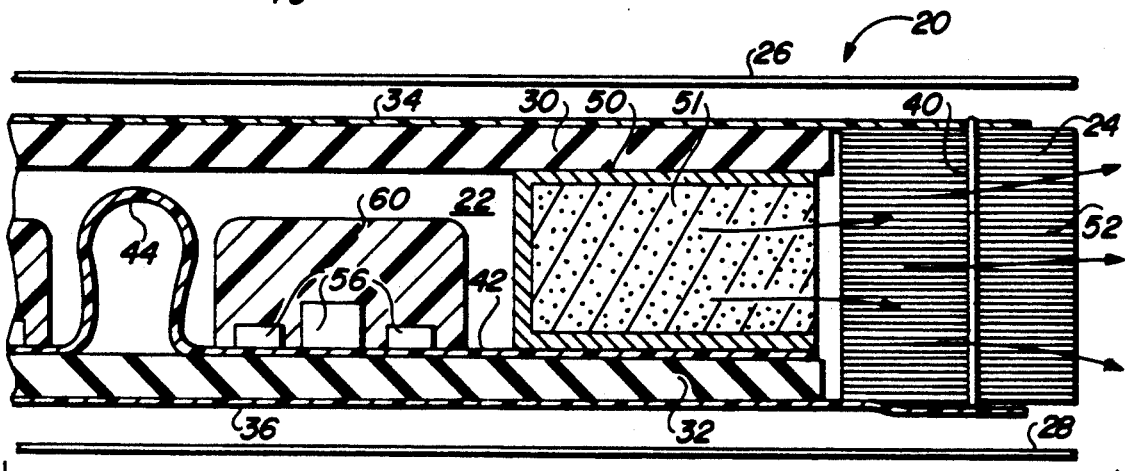
FIG. 5
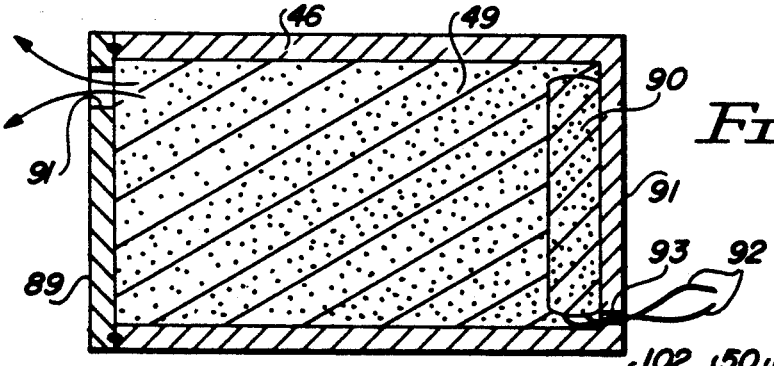
FIG. 6
FIG. 7
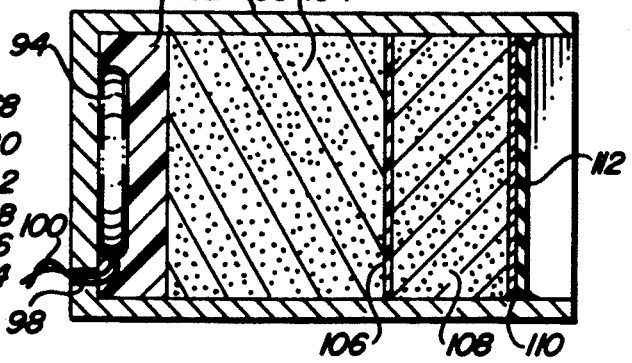
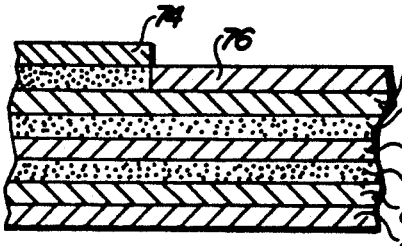
FIG. 8

+6V LOGIC
+6V TO SQUIBS
SQUIB
DET
S
C
J3
J2
TO BATTERY
+V
+6V
RC
CX
VCC
VSS
+T
-T
R
Q
CLK
EN
RST
Q1
Q2
Q3
Q4
U1

BENDABLE CURRENCY SECURITY DYE PACK

BACKGROUND OF THE INVENTION

1. Field of the Invention

The present invention relates generally to security systems for aiding authorities in the apprehension of bank robbers and the recovery of stolen monies, and more particularly, to security systems employing currency packs disguised as bundles of currency bills for discharging tear gas, dye, smoke and/or other chemicals in the event of a robbery.

2. Description of the Prior Art

Among the devices which have been used by banks and other financial institutions to deter bank robberies, and to aid in the apprehension of a thief and the recovery of stolen monies, are security dye packs disguised as a strapped bundle of currency bills. Such security dye packs are normally kept in a teller drawer along with actual currency bills and are handed to a robber by the teller during a bank robbery. The top and bottom faces of the security dye pack are concealed by actual currency bills to simulate actual bundles of currency bills. The disguised security dye packs actually conceal canisters containing tear gas, dye, smoke and/or other active chemicals which can be discharged from the security dye pack to assist in the recovery of stolen monies; and to assist in the apprehension of an assailant.

Tear gas helps to hinder the robber, making it more difficult for the robber to escape from the scene of the crime. Dye serves to stain any bills in the vicinity of the security dye pack, making such bills unspendable and easier to trace; the dye also may stain the skin and clothing of the robber, making it easier for authorities to identify the robber. Smoke provides a visible signal for authorities to follow to help locate the robber and the stolen funds. In addition, such security dye packs often emit a loud bang upon being expended, tending to confuse the robber and aiding authorities in apprehending the robber.

Several methods have been used to actuate such security dye packs upon unauthorized removal from a protected premises. For example, some security dye packs are normally kept in the teller drawer on a magnetic keeper plate. A magnetic reed switch within the security dye pack disables the unit from detonating so long as the reed switch is within the influence of the magnetic field of the keeper plate. Once removed from the keeper plate, a timer is activated, and when the timer has reached a predetermined count, the canisters are activated to deploy the active chemical agents. Another variety of such security dye packs includes a plug anchored by a pull wire to the teller drawer; removal of the security dye pack from the teller drawer causes the plug to be removed from the unit, thereby arming the device. Such security dye packs are generally described, for example, within U.S. Pat. No. 3,303,592 issued to Harner; and within U.S. Pat. No. 3,424,122 issued to De Angelis.

More sophisticated security dye packs contain miniature radio receivers which are tuned to receive a localized radio signal broadcasted by an antenna in the vicinity of the entry doors to the bank. The transmitted signal is limited to the vicinity of the doors and does not normally extend to the teller area. If a security dye pack is handed to a robber and is thereafter brought into the field of the broadcasted radio signal, the transmitted signal is detected by the radio receiver to arm the security dye pack. The security dye pack may then immediately be detonated, or a time delay circuit can hold off detonation of the chemical canisters for a predetermined amount of time to permit the robber to first exit the premises. Modern security dye packs often include a hold-off circuit preventing the security dye pack from being detonated until the robber has left the field of the transmitted signal. In addition, modern security systems often employ digital coding techniques to minimize the likelihood of inadvertent detonation due to stray radio signals generated by other electronic equipment within the banking environment. Examples of such radio-activated security dye packs are those generally described within U.S. Pat. No. 3,564,525, issued to Robeson, et al., and reissued as Reissue U.S. Pat. No. Re. 27,618; U.S. Pat. No. 3,781,860 issued to Freyling, Jr.; U.S. Pat. No. 3,828,341 issued to Carter, Jr., et al.; U.S. Pat. No. 4,511,888 issued to Bernhardt: U.S. Pat. No. 4,559,529 issued to Bernhardt; and U.S. Pat. No. 4,604,607 issued to Sanderford, Jr., et al.

Unfortunately, as the technology of such security dye packs advances, so does the knowledge and experience of assailants. For example, older security dye packs had relatively rigid edges that could not be fanned to see the edges of individual bills. Accordingly, robbers could easily detect a security dye pack by fanning the edges of each currency bundle. Modern security systems use actual currency bills loosely sewn together for allowing the edges to be fanned by a robber without alerting the robber to the true nature of the security dye pack.

Moreover, the chemical canisters and related electronic components and circuit board within such security systems are relatively rigid and, in the past, would make a distinctive sound when the security dye pack is rapped upon a teller counter. Experienced bank robbers have been known to rap currency bundles upon the teller counter before leaving the bank to detect the true identity of a security dye pack, and to leave the security dye pack within the bank before making their escape. This problem has largely been solved by placing thin foam cushions above and below the rigid components within the security dye pack to cushion such rigid components when the unit is rapped on a hard surface.

Another method which has been used by knowledgeable robbers to quickly determine whether a bundle of currency is genuine is to bend the bundle into a U-shape. An actual bundle of currency bills is flexible enough to be bent back upon itself into a U-shape. On the other hand, due to the rigid canisters and circuit boards hidden inside prior art security dye packs, such units can not be bent into a U-shape. Knowledgeable robbers have been known to test currency bundles handed to them by a teller/cashier by bending such bundles into a U-shape to quickly detect any bogus bundles.

Recently, the ICI Aerospace Division of ICI Americas Inc. based in Valley Forge, Pa. has introduced a security dye pack under the registered trademark "SecurityPac", available as Part No. PN 500-00443, also known as the "FlexPac", wherein a single, relatively large, rigid chemical canister is positioned within the central portion of the security dye pack. Rigid circuit boards are positioned upon opposing sides of the chemical canister and are connected to each other by a flexible mylar interconnect strap having electrical conductors embedded therein. A first bendable joint is formed between the canister and the first rigid circuit board on a first side of the canister. A second bendable joint is formed between the canister and the second rigid circuit board on the opposing second side of the canister. In this manner, the resulting security dye pack can be bent into a generally S-shaped structure. The aforementioned "FlexPac" security dye pack is generally more flexible than past security dye packs; however, such "FlexPac" security dye packs are unable to be bent into a U-shape since the rigid chemical canister is positioned squarely in the middle of the unit.

Another aspect of security dye packs which limit their flexibility are the battery cases used to encase the batteries that supply electrical power to the electrical components housed within such security dye packs. Often, such security dye packs utilize disc-shaped silver oxide batteries for long life to extend maintenance schedules. Such batteries are typically interconnected in serial fashion to develop sufficient voltage to drive the associated radio receiver and logic circuitry and to fire the electrically-activated squibs to discharge the chemicals stored within the chemical canister. In the past, such batteries have been arranged in a flat, spaced arrangement, with the battery discs disposed generally parallel to the upper and lower faces of the currency bundle, resulting in a generally square battery case that minimizes the height of such battery cases. While such technique does serve to decrease the height of such battery cases, it simultaneously causes the width of the battery case to be relatively large; the sizable width of such battery cases makes it more difficult to produce a flexible security dye pack.

As noted above, security dye packs commonly include a canister containing a chemical dye to mark bills in the vicinity of the security dye pack. In some instances, the dye is also discharged upon the skin and clothing of the robber, making it easier for authorities to identify participants in the robbery. Known security dye packs discharge dye primarily in a single direction. Thus, if the security dye pack is not directed toward the robber or toward other currency bills, the dye may be discharged without effectively staining surrounding bills and/or the robber.

Accordingly, it is an object of the present invention to provide a security dye pack disguised as a bundle of currency bills for assisting in the apprehension of a robber, and in the recovery of stolen monies from a protected premises, wherein such security dye pack is capable of being bent into a U-shape to avoid detection by knowledgeable thieves.

It is a further object of the present invention to provide such a security dye pack which is largely flexible along its length to facilitate bending of the unit.

It is a still further object of the present invention to encase the batteries providing electrical power to the electrical components of the security dye pack in a manner which facilitates bending of the security dye pack.

Still another object of the present invention to provide such a security dye pack capable of discharging dye or other active chemicals in two opposing directions for increasing the likelihood of marking stolen monies and/or the robber when the dye is discharged from the security dye pack.

These and other objects of the present invention will become more apparent to those skilled in the art as the description thereof proceeds.

SUMMARY OF THE INVENTION

Briefly described, and in accordance with a preferred embodiment thereof, the present invention relates to a security dye pack disguised as a bundle of currency bills for assisting in the apprehension of an assailant and in the recovery of monies stolen from a protected premises, and including a housing resembling a bundle of currency bills and having a hollowed inner chamber. The security dye pack includes a substrate disposed within the hollowed inner chamber and having a flexible central region and opposing first and second ends. Electronic circuit components are supported upon the substrate outside the central region thereof, leaving the central region highly flexible. Such electronic circuit components serve to detect removal of the security dye pack from the protected premises and generate an actuating electrical current in response thereto.

One or more canisters are secured to the substrate outside the central region thereof, such canisters being responsive to the actuating electrical current for discharging tear gas, dye, or other active chemicals from said housing. A battery pack is also secured to the substrate outside the central region thereof for supplying electrical power to the electronic circuit components.

The substrate permits the security dye pack to be bent about the flexible central region thereof into a U-shape to help avoid detection by a robber while supporting the electronic circuit components, canister, and battery pack within the hollowed inner chamber of the housing.

Preferably, the substrate includes a plurality of electrical conductors extending through the flexible central region thereof to interconnect electronic circuit components mounted upon opposing ends of the substrate, and to interconnect the battery pack thereto. The flexible central region of the substrate has a generally U-shaped loop formed therein for allowing the security dye pack to be bent into a U-shape in either direction without creating tension in the central flexible region of the substrate.

In the preferred embodiment of the present invention, each side of the substrate has a thickened portion proximate the flexible central region and a thinner flexible portion spaced apart from the flexible central region by the thickened portion. The thickened portions of the substrate form a pair of circuit boards upon which first and second groupings of electronic components are mounted. A first canister containing tear gas, dye, or other active chemicals, is secured to the thinner flexible portion of the first end of the substrate, and a second canister containing active chemicals is secured to the thinner flexible portion of the second end of said substrate. Preferably, such canisters are directed in opposing directions for discharging dye or other active chemicals from the security dye pack in opposing directions.

To further facilitate the bending of the security dye pack, the aforementioned battery pack includes a number N of button-like batteries each having a circular periphery and a predetermined diameter D and thickness T, arranged side-by-side in a row in abutting relationship, the circular periphery of each such battery adjoining the circular periphery of another such battery. An elongated case is provided for supporting such batteries, the case having a chamber of a length approximately equal to the number N of batteries multiplied by the diameter D of such batteries, a height approximately equal to diameter D, and a width approximately equal to thickness T. The case thereby supports the batteries in the form of an elongated, thin package. Connectors electrically serially connect the batteries for supplying electrical power to the electronic components. Each of the batteries preferably includes an insulated coating formed about the circular periphery thereof to insulate each such battery from the other adjoining batteries.

A particularly advantageous form of the invention uses a at least one canister having a predetermined length L, and wherein the length of said battery case is approximately equal to the length of the canister. The battery case is disposed substantially adjacent and parallel to the canister, wherein the length direction of the canister and the length direction of the battery case are each oriented perpendicular to the longitudinal axis of the security dye pack.

BRIEF DESCRIPTION OF THE DRAWINGS

FIG. 1 is a perspective view of a security dye pack constructing in accordance with the teachings of the present invention, and wherein an actual ten dollar bill covering the upper face of the security dye pack has been raised to reveal a hollowed inner chamber. FIG. 2 is a sectional view of the security dye pack shown in FIG. taken through the plane designated by lines 2—2 within FIG. 1.

FIG. 3 is a sectional view of the security dye pack shown in FIG. 3 after bending the same into an inverted U-shape.

FIG. 4 is a top view of a flexible substrate used to support circuit components, a battery pack, and canisters within the inner chamber of the security dye pack.

FIG. 5 is an enlarged partial sectional view of the portion of the security dye pack outlined by dashed rectangle 5 within FIG. 2.

FIG. 6 is an enlarged sectional view of a canister used to emit smoke and dye from the security dye pack.

FIG. 7 is a sectional view of a canister used to discharge tear gas and dye from the security dye pack.

FIG. 8 is a sectional view of a printed circuit board portion of the substrate shown in FIG. 4 illustrating the formation of a multiple layer printed circuit board upon such substrate.

FIG. 9 is a perspective view of a battery case and illustrating the manner by which such battery case is secured and electrically interconnected with a printed circuit board portion of such substrate.

FIG. 10 is a sectional view of the battery case shown in FIG. 9 taken through the plane designated by lines 10—10 and illustrating the arrangement of serially connected batteries therein.

DETAILED DESCRIPTION OF THE PREFERRED EMBODIMENT

Figure 11:
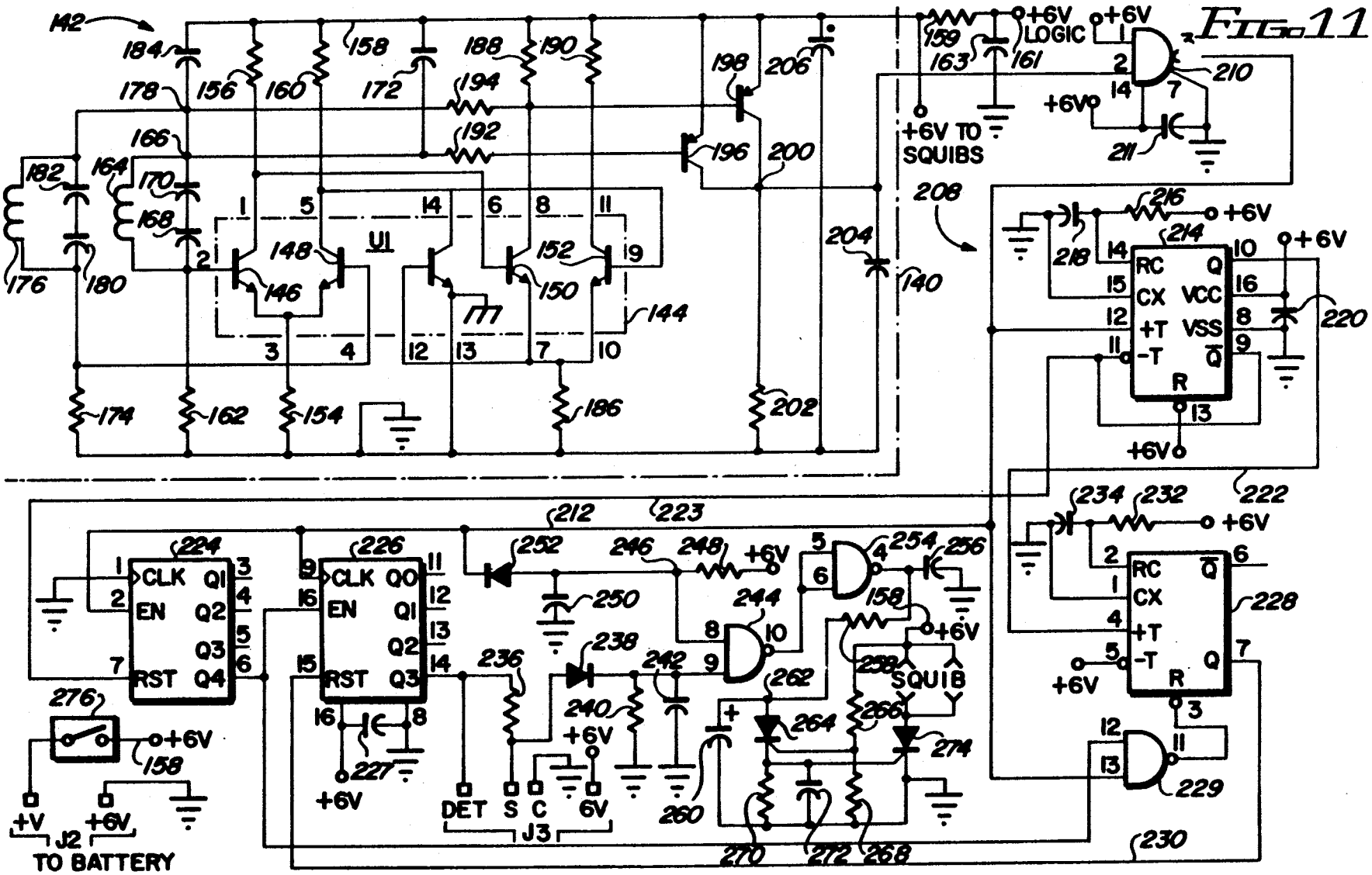
FIG. 11 is a circuit schematic of the electrical components supported upon the aforementioned substrate in order to discharge tear gas, smoke, and dye from the security dye pack upon detecting removal of the security dye pack from a protected premises.

In FIG. 1, a security dye pack constructed in accordance with the teachings of the present invention is designated generally by reference numeral 20. As shown in FIG. 1, security dye pack 20 is disguised as a bundle of currency bills. The bundle of currency bills is hollowed out to form an inner rectangular chamber 22, and the hollowed bundle of currency bills thereby forms a housing 24. The upper face of security dye pack 20 is covered by an actual currency bill 26. Similarly, the lower face of security dye pack 20 is covered by a similar actual currency bill 28 (see FIG. 5). Actual currency bills 26 and 28 are secured to housing 24 by a strap 28 of the same type ordinarily used to strap together bundles of currency bills. Also visible within FIG. 1 is a thin cushioning layer of foam rubber 30 which, as noted above, cushions the components housed within inner chamber 22 if security dye pack 20 is rapped against a teller counter or other hard surface. A similar layer of cushioning foam 32 (see FIG. 2) covers the bottom side of inner chamber 22 to similarly cushion the components disposed within inner chamber 22 against impact with the bottom portion of security dye pack 20. Foam layer 30 is retained within inner chamber 22 by a transparent plastic cover 34 which overlies the upper face of housing 24; a similar transparent plastic cover 36 (see FIG. 5) extends over the bottom face of security dye pack 20 and retains lower foam layer 32 within inner chamber 22.

Referring to FIG. 2, housing 24 is preferably formed from actual treasury bills with their center portions removed to form hollow inner chamber 22. In order to permit the edge portions of security dye pack 20 to be fanned, and thereby simulate the look and feel of actual strapped bundles of currency, a pair of holes are drilled through the bundle of bills at each end thereof, and elastic cords 38 and 40 are threaded through such holes to loosely fasten the bills to one another as a bundle. As shown in FIG. 5, elastic thread 40 may also pass through and/or over transparent plastic cover 34 to retain plastic cover 34 to the upper face of housing 24.

The basic components housed within inner chamber 22 are visible within the cross-sectional drawings shown in FIG. 2. Substrate 42 extends the length of inner chamber 22 and includes an inverted U-shaped flexible central region 44 to facilitate bending of security dye pack 20 into a U-shape in either direction. For example, within FIG. 3, security dye pack 20 is shown after having been bent into an inverted U-shape. Those skilled in the art will appreciate that security dye pack 20 may be bent in the opposite direction to form an upright U-shaped structure.

Still referring to FIGS. 2 and 3, a first metal canister 46 is supported upon substrate 42 proximate first end 48 of security dye pack 20. Canister 46 contains chemical dye and smoke powder 49 which, upon being ignited, is discharged through an opening within first end 48 of security dye pack 20 as shown in FIG. 2. Security dye pack 20 includes a second canister 50 supported by substrate 42 proximate second end 52 of security dye pack 20. Canister 50 contains tear gas and dye 51 for being rapidly discharged through second end 52 of security dye pack 20. Because the currency bills forming housing 24 are loosely held together by elastic threads 38 and 40, first end 48 and second end 52 of housing 24 are relatively permeable to the passage of dye, smoke, tear gas and/or other active chemicals therethrough.

Also shown within FIGS. 2 and 3 are a first group of electrical components 54 and a second group of electrical components 56 mounted substrate 42 upon opposing sides of central flexible region 44. Such electrical components represent integrated circuits, transistors, resistors, and the like. When such electrical components are properly interconnected, they form an electronic circuit means for detecting removal of security dye pack 20 from a protected premises in order to generate an actuating electrical current in response thereto for expending the chemicals charged within canisters 46 and 50.

As indicated in FIG. 2, such electrical components may be encased by epoxy covers 58 and 60, if desired. Also shown within FIG. 2 is a battery case 62 secured to and supported by substrate 42 and lying substantially along and parallel canister 46. As is explained in greater detail below, battery pack 62 provides electrical power to electrical components mounted upon substrate 42.

Substrate 42 is best shown in FIG. 4. Flexible central region 44 physically connects first end portion 64 to second end portion 66. Substrate 42 is preferably formed of flexible mylar material. As shown in FIG. 4, the width of substrate 42 is greatly narrowed within central region 44 to increase the flexibility thereof, and to facilitate bending of security dye pack 20 into a U-shape.

First end portion 64 of substrate 42 is divided into two portions Thickened portion 68 of first end 64 has a greater thickness than either central flexible region 44 or thinner flexible portion 70. Similarly, second end portion 66 of substrate 42 includes thickened portion 72 and thinner flexible portion 74. Thickened portions 68 and 72 provide first and second printed circuit boards, respectively, to form electrical interconnections with the electrical components mounted thereto. Referring briefly to FIG. 8, the laminated structure of thickened portion 68 of substrate 42 is shown in greater detail. Layer 74 is a dialectric which selectively insulates underlying photo imagable solder masklayer 76. Layer 78 designates a first layer of metal cladding which is adhesively secured by adhesive layer 80 to a central dialectric layer 82. Similarly, layer 84 represents a second photo imagable solder mask overlying a layer of metal cladding 86 adhesively secured by adhesive layer 88 to central dialectric layer 82. In this manner, thickened portions 68 and 72 of substrate 42 each provide a dual metal layer printed circuit board upon which electrical components are physically supported and electrically interconnected. Moreover, a plurality of copper clad, solder-coated electrical conductors extend through flexible central region 44 for affecting interconnections between the printed circuit board formed upon thickened portion 68 and the printed circuit board formed upon thickened portion 72. Finally, canister 46 is secured, as by a suitable adhesive, to thinner portion 70 of first end portion 64, while metal canister 50 is secured as by a suitable adhesive to thinner portion 74 of second end 66 of substrate 42.

FIG. 6 is an enlarged sectional drawing of canister 46. Such metal canisters are generally available from Hudson Tool and Die Company, Inc. of Newark, N.J. and have a rectangular configuration with one open end. As shown in FIG. 6, the open end of canister 46 is sealed by a plastic cap 89 having one or more holes 91 formed therein for allowing smoke and dye to be discharged therethrough. The smoke and dye powder 49 is charged within canister 46. Squib 90 is packed against rear wall 91, and a small hole 93 is drilled in rear wall 91 for extending electrical lead wires 92 therethrough. Squib 90 contains an ignition mix which burns when an electrical current is conducted through electrical lead wires 92. The burning ignition mix chemically activates the smoke and dye powder 49, which is then discharged outwardly through aperture 91 of cap 89 in the direction indicated by the arrows in FIG. 6.

FIG. 7 illustrates the internal structure of metal canister 50 used to discharge both tear gas and dye from second end 52 of security dye pack 20. Squib 94 is positioned against the back wall 96 of canister 50. A small hole 98 is drilled in back wall 96 for allowing lead wires 100 to be extended therethrough. Squib 94 includes a gelatin capsule housing containing pyrotechnics, for example, Pyrodex-brand gunpowder for causing a small explosion when an electrical current is conducted through squib 94 by lead wires 100. Squib 94 is surrounded by a clear epoxy 102 which is blown out of metal canister 50 upon detonation of squib 94, thereby causing a loud bang and rapidly expanding the contents of metal canister 50.

Still referring to FIG. 7, a quantity of tear gas powder 104 is packed adjacent clear epoxy 102. Tear gas 104 is held in place by a thin wall of plastic 106. A quantity of dye powder 108 is then packed into canister 50 in front of dividing plastic wall 106. A thin layer of cardboard 110 maintains the dye powder in place. Finally, a thin layer of RTV Sealant 112 secures cardboard wall 110 in place until squib 94 is fired. Upon being actuated, squib 94 explodes, forcing epoxy 102, tear gas 104 and dye 108 to be expended through second end 52 of security dye pack 20 in the direction indicated by the arrows within FIG. 5.

As noted above, with respect to FIGS. 2 and 6, canister 46 discharges dye and smoke outwardly through second end 48 of security dye pack 20 in the direction indicated by the arrows pointing to the left within FIG. 2. As also noted above with respect to FIG. 2 and FIG. 5, canister 50 causes tear gas and dye to be discharged through second end 52 in the direction indicated by the arrows pointing to the right within FIG. 2. Thus, by positioning metal canisters 46 and 50 at opposing ends of security dye pack 20, and by directing such metal canisters in opposing directions, dye and/or other active chemicals are caused to be discharged in two opposing directions simultaneously upon detonation of security dye pack 20. The ability to discharge dye in two opposing directions increases the likelihood that the dye will come in contact with and stain the robber's skin and/or clothing. Moreover, if the security dye pack 20 is tossed into a bag or briefcase, the discharge of dye from both ends 58 and 52 of security dye pack 20 increases the likelihood that the dye will completely cover and mark all other currency bills placed within such bag or briefcase.

As noted above, security dye pack 20 includes a battery pack 62 wherein a number of batteries are supported by a battery case to supply electrical power to the electrical components that detect removal of the security dye pack from the protected premises. As further discussed above, the particular manner of arranging such batteries can impact the flexibility of the security dye pack. FIGS. 2, 9 and 10 illustrate a particularly advantageous arrangement of such batteries in order to facilitate the flexibility of security dye pack 20. As shown in FIGS. 9 and 10, a group of four button-like silver oxide batteries 114, 116, 118 and 120 each have a circular periphery and a predetermined diameter D and thickness T. Such batteries may be of the type commercially available as Everready-brand Part No. 76. Batteries 114, 116, 118 and 120 are supported within an internal chamber of elongated battery case 62, wherein batteries 114, 116, 118 and 120 are arranged side-by-side in a row in generally abutting relationship. The peripheral arcuate edges of each such battery are electrically insulated by a plastic insulating film 122 heat-shrink wrapped about each such battery without covering the planar circular front and rear faces of each such battery. The batteries are preferably positioned in contact with one another, the arcuate periphery of one battery abutting the arcuate periphery of the adjoining battery, to conserve space, and to form a compact structure. The heat-shrink plastic film ensures that the abutting walls of such batteries remain electrically insulated from one another.

To serially interconnect such batteries, a first flat electrical contact 124 contacts the upper face of battery 114; contact 124 is electrically interconnected with terminal socket 126. Electrical contact 124 may be in the form of a soft tin strap that is welded to the upper face of battery 114. The lower face of battery 114 and the lower face of adjoining battery 116 are electrically interconnected by flat electrical contact 126. Similarly, the upper face of battery 116 and the upper face of battery 118 are electrically interconnected with one another by a flat electrical contact 128. The lower faces of batteries 118 and 120 are also interconnected with each other by flat electrical contact 130. Finally, the upper face of battery 120 is contacted by flat electrical contact 132 which is, in turn, electrically coupled with terminal socket 134.

Battery case 62 is supported upon substrate 42 by engaging terminal sockets 126 and 134 over terminal pins 136 and 138, respectively. Terminal pins 136 and 138 are soldered to, and extend upwardly from, thickened portion 68 of the first end 64 of substrate 42.

As indicated within FIG. 10, the length of the chamber within battery case 62 is approximately equal to four times the diameter of batteries 114, 116, 118 and 120. The height of the chamber Within battery case 62 is approximately equal to the diameter of each such battery; as shown in FIG. 9, the height of battery case 62 is just slightly greater than the diameter of such batteries. The width of the chamber within battery case 62 is approximately equal to the thickness of such batteries, and as shown in FIG. 10, the width of battery case 62 is just slightly larger than the thickness of such batteries. In this manner, batteries 114, 116, 118 and 120 are supported in the form of an elongated, relatively thin package. As shown in FIG. 2, battery case 62 neatly fits upon substrate 42 extending along and parallel to canister 46, perpendicular to the longitudinal axis of security dye pack 20, and adjacent circuit components 54. By minimizing the width of battery case 62, the flexibility of substrate 42 and security dye pack 20 is enhanced.

FIG. 11 is a circuit schematic of the radio receiver components and other electronic components collectively responsible for detecting the removal of the security dye pack from the protected premises and discharging the tear gas, smoke, dye and/or other active chemicals from canisters 46 and 50. Dashed line 140 in FIG. 11 separates radio receiver portion 142 from the remainder of the logic circuitry 208 and other electronic components shown in FIG. 11. Radio receiver 142 is designed to receive a radio frequency signal of 50 KHz. transmitted by a radio transmitter antenna surrounding the exit doors of the bank or other premises to be protected. The field of the transmitted 50 KHz. signal is localized to the vicinity of the exit door and does not extend as far as the area of the teller drawers or other areas where money is normally kept within the protected premises.

The transmitted 50 KHz. signal is preferably transmitted in a predetermined binary code which may be impressed upon the carrier signal by known on-off keying techniques. The binary code impressed upon the 50 KHZ. carrier signal includes streams of data bits, each stream being of the same duration and including eight data bits. The streams are separated from one another by a set interval, the interval preferably being equal to the duration of one stream of eight data bits. The logic circuitry of the security dye pack checks to determine whether it has received eight such streams of eight data bits each. If so, the logic circuitry of the security dye pack recognizes the received signal as being the proper signal rather than being a stray signal received from other equipment within the protected premises.

The front end of receiver 142 includes an integrated circuit chip 144 of part type LM 3086 containing matched pairs of differentially coupled transistors 146/148 and 150/152. The common emitters of differential transistor pair 146 and 148, corresponding to pin 3 of chip 144, are coupled through current source resistor 154 to ground potential. The collector of transistor 146, corresponding to pin 1 of chip 144, is coupled through load resistor 156 to voltage supply conductor 158; conductor 158 provides a voltage of six volts derived from battery pack 62 (see FIGS. 9 and 10), coupled through reed switch 276, the function of which is described in greater detail below. Similarly, the collector of transistor 148, corresponding to pin 5 of chip 144, is coupled through load resistor 160 to voltage supply conductor 158.

The base of transistor 146, corresponding to pin 2 of chip 144, is coupled by resistor 162 to ground, and by inductor 164 to node 166. Capacitors 168 and 17 are series-coupled between the base of transistor 146 and node 166. Capacitor 172 couples node 166 to voltage supply conductor 158. The base of transistor 148, corresponding to pin 4 of chip 144, is coupled by resistor 174 to ground, and by inductor 176 to node 178. Capacitors 180 and 182 are series-coupled between the base of transistor 148 and node 178. Capacitor 184 couples node 178 to voltage supply conductor 158. The values of the inductors and capacitors used within this first stage of the receiver are selected to tune the receiver for maximum sensitivity at 50 KHz.

The differential output signal developed across load resistors 156 and 160 by the first stage of the receiver is used to differentially drive a second amplification stage of the receiver. The collector of transistor 146 is coupled to the base of transistor 150, corresponding to pin 6 of chip 144. Similarly, the collector of transistor 148 is coupled to the base of transistor 152, corresponding to pin 9 of chip 144. The emitter terminals of transistors 150 and 152, corresponding to pins 7 and 10 of chip 144, are coupled in common, and current source resistor 186 couples the common emitter terminals to ground. The collector of transistor 150, corresponding to pin 8 of chip 144, is pulled up by load resistor 188 to voltage supply conductor 158. Similarly, the collector of transistor 152, corresponding to pin 11 of chip 144, is pulled up by load resistor 190 to voltage supply conductor 158. Feedback resistor 192 couples the collector of transistor 152 back to node 166 of the input stage, and feedback resistor 194 couples the collector of transistor 150 back to node 178 of the input stage. The values for the resistors, inductors, and capacitors identified above are set forth later in this specification. The values for resistors 162 and 174 are equal to each other and lie in the range of 680 K ohms to 1 Meg ohm. Final values for resistors 162 and 174 are selected empirically by testing to achieve proper bias.

The differential output signal generated by the second stage of the receiver is coupled to the base terminals of PNP output transistors 196 and 198, which are of part type 2N5087. Each of transistors 196 and 198 has its emitter terminal coupled to voltage supply conductor 158, and each has its collector terminal coupled to output node 200 Output node 200 is coupled by load resistor 202 to ground. Capacitor 204 is also coupled from output node 200 to ground, wherein resistor 202 and capacitor 204 have a characteristic R-C time constant. When a 50 KHz. signal is being received, output node 200 charges toward the six volt supply. When no 50 KHz. signal is present, as when the carrier signal is keyed off, output node 200 discharges to ground. In addition, a filter capacitor 206 is coupled between voltage supply conductor 158 and ground to eliminate any a.c. voltage component from the power supply line. To further isolate a.c. components or spikes from the logic circuity, resistor 159, having a value of 100 ohms, is interposed between voltage supply conductor 158 and the +6 volt voltage supply 161 for logic circuitry 208. Filter capacitor 163, having a value of 4.7 microfarads, extends between the logic section +6 V supply terminal 161 and ground potential.

Logic circuit portion 208 of the electronic circuitry shown in FIG. 11 includes a NAND gate 210 configured as an invertor; NAND gate 210 is one-fourth of an integrated circuit chip of part-type HEF 4093. Input pin 1 is tied to the voltage supply conductor 158. Input pin 2 receives the signal generated at output node 200 of receiver 142. NAND gate 210 shapes and inverts the signal at node 200 to provide a binary signal with sharp rising and falling edges at output pin 3 thereof. Output pin 3 of NAND gate 21 is coupled to conductor 212, which is in turn coupled to input pin 12 (the positive trigger input) of integrated circuit 214, a monostable multivibrator of part type 4538SMD. Integrated circuit 214 is triggered by receipt of a data bit (i.e., a rising edge at the output of NAND gate 210) to develop a timing signal of a time period having a duration equal slightly longer than the duration of a stream of eight data bits in the selected binary code being transmitted by the transmitter. The duration of the timing signal is determined by an R-C time constant based upon the values of resistor 216 and capacitor 218, as shown in FIG. 11. The positive output of integrated circuit 214, corresponding to pin 10, is coupled to conductor 222. The complementary output (pin 9) is coupled to the inverting trigger input (pin 11) and to conductor 223.

Conductor 212, which conducts the output signal from NAND gate 210, is also coupled to the enable input terminal (pin 2) of integrated circuit 224, a four-bit binary counter of part type HEF4520. Integrated circuit 224 has four output terminals Q1, Q2, Q3, and Q4, wherein output terminal Q4 is the most-significant bit. The binary counter of integrated circuit 224 is initially reset by conductor 223, via the reset input terminal (pin 7), each time monostable multivibrator 214 is triggered. Assuming that the binary counter of integrated circuit 224 is initially at a binary count of zero (0000), integrated circuit 224 must receive eight consecutive input pulses from conductor 212 on enable pin 2 before reaching a binary count of eight (1000) and causing output Q4 (pin 6) to reach a logic "1". Thus, integrated circuit 224 serves as a bit counter to count eight data bits in one bit stream. These eight data bits must be received within the period of time that is timed by bit stream timer 214; if bit stream timer 214 times out before all eight bits are received, then the inverting output terminal (pin 9) of bit stream timer 214 will go to logic "1", causing the count within bit counter 224 to be reset.

Integrated circuit 226 is a second binary counter, also of part type HEF4520, and serves to count eight data streams. The clock input terminal (pin 9) of counter 226 is coupled to conductor 212 for receiving the output of NAND gate 210. The enable input terminal (pin 16) of counter 226 is coupled to output Q4 of bit counter 224. Each time bit counter 224 reaches a count of eight ("1000"), stream counter 226 is incremented with the receipt of the next data bit. Stream counter 226 is initially reset when the first data bit is detected by NAND gate 210. As mentioned above, monostable multivibrator 214 is triggered by the receipt of the first date bit; output conductor 222 is coupled to the trigger input terminal (pin 4) of a second monostable multivibrator 228, also of part type 4538SMD. Monostable multivibrator 228 is a stream interval timer which provides an output signal Q (pin 7) which lasts for a duration just greater than the amount of time that elapses between successive data streams. The interval timed by stream interval timer is determined by the R-C time constant of resistor 232 and capacitor 234.

The output of stream interval timer 228 initially goes high when bit stream timer 214 is triggered by the first data pulse. When output Q (pin 7) of stream interval timer goes high, it applies a reset pulse, via conductor 230, to the reset input terminal of stream counter 226. Stream counter 226 is incremented each time bit counter 224 reaches a count of eight ("1000"). Thus, when bit counter 224 has received eight streams of eight data bits each, stream counter 226 will have reached a binary count of eight ("1000"), causing output terminal Q3 (pin 14) of stream counter 226 to reach a logic "1". However, the eight streams of data bits must be received within the expected period of time.

The output of stream interval timer 228 initially goes high when bit stream timer 214 is triggered by the first data pulse. When output Q (pin 7) of stream interval timer goes high, it applies a reset pulse, via conductor 230, to the reset input terminal of stream counter 226. Stream counter 226 is incremented each time bit counter 224 reaches a count of eight ("1000"). Thus, when bit counter 224 has received eight streams of eight data bits each, stream counter 226 will have reached a binary count of eight ("1000"), causing output terminal Q3 (pin 14) of stream counter 226 to reach a logic "1". However, the eight streams of data bits must be received within the expected period of time. If, for example, nine data bits are received within the period of time normally allowed to receive eight data bits, then both the Q4 output terminal (pin 6) of the bit counter 224 and conductor 212 will both be at a logic "1" level before bit stream timer 214 has timed out; in this event, both input terminals (pins 12 and 13) of NAND gate 229 will be high, causing the output terminal (pin 11) of NAND gate 229 to go low, thereby resetting stream interval timer 228, which in turn resets stream counter 226. In other words, receipt of an extra data bit clears the stream counter 226 to prevent recognition of a valid transmission. Similarly, if stream interval timer 228 is not retriggered by bit stream timer 214 (indicating the start of a new stream) before stream interval timer 228 times out from the prior stream, then the unit should recognize any data received to such point; accordingly, upon timer 228 timing out, the output terminal (pin 7) thereof goes low and resets stream counter 226 to clear the valid stream count back to zero.

Assuming that eight streams of eight data bits have been received, output terminal Q3 of stream counter 226 will rise to logic "1". Output terminal Q3 is coupled by resistor 236 and diode 238 to an R-C charging network including resistor 240 and capacitor 242. The signal shaped by the R-C network is coupled to an input terminal (pin 9) of NAND gate 244. The second input terminal (pin 8) of NAND gate 244 is coupled to node 246; node 246 is coupled through pull-up resistor 248 to the voltage supply conductor 158, and is also coupled to ground through capacitor 250. Node 246 is also coupled to conductor 212 through diode 252. Thus, when the voltage on conductor 212 goes low, diode 252 turns on, and discharges capacitor 212. When the voltage on conductor 212 returns high, the voltage at node 246 slowly rises as resistor 248 charges capacitor 250.

The output (pin 10) of NAND gate 244 can go low only if both input terminals (pins 8 and 9) are high. Pin 9 will remain high after stream counter 226 has reached a count of eight. However, so long as the security dye pack remains in the field of the transmitted signal (i.e., in the vicinity of the door), the voltage at node 246 will be discharged each time a new data bit is received. Only after the security dye pack leaves the field of the transmitted signal (and the assailant has left the protected premises), will the voltage at node 246 rise to a logic "1" level. Thus, NAND gate 244 and components 248, 250, and 252 provide a hold-off feature which prevents the security dye pack from expending any chemicals until after the assailant leaves the protected premises.

The output of NAND gate 244 is coupled to both input terminals (pins 5 and 6) of a further NAND gate 254 configured as an invertor. The output terminal (pin 4) of NAND gate 254 is coupled to an R-C charging network including capacitor 256, resistor 258, and capacitor 260. As the output of NAND gate 254 rises, the voltage at node 262 slowly rises. Through proper selection of values of resistor 258 and capacitors 256 and 260, a predetermined time delay of, for example, five seconds may be provided to further delay expenditure of the active chemicals for five seconds after the assailant has left the field of the transmitted signal.

Node 262 is coupled to the anode of a silicon-controlled-rectifier (SCR) 264 of part type 2N6028. A voltage divider network including resistors 266 and 268 biases SCR 264 to normally be non-conductive. When the voltage at node 262 rises above a predetermined voltage, SCR 264 breaks down and becomes conductive, thereby sending current through resistor 270 and charging capacitor 272. As the voltage across resistor 270 increases, a second SCR 274 of party type 2N5061 breaks down and becomes conductive. As indicated in FIG. 11, SCR 274 conducts an electrical current through the squibs 90 and 94 within canisters 46 and 50 (see FIGS. 6 and 7, respectively) to expend the chemicals within canisters 46 and 50. As indicated in FIG. 11, the squibs are tied directly to receiver voltage supply conductor 158, bypassing resistor 159 to avoid voltage drops that would otherwise result if resistor 159 conducted the current passing through the squibs.

Within FIG. 11, a magnetically-responsive reed switch 276 is illustrated interposed between the +6 Volt battery supply voltage and the voltage supply conductor 158. This read switch may be used to conserve battery power when the security dye pack is kept within a teller drawer for long periods of time. The teller drawer is equipped with a magnetic keeper plate (not shown) upon which the security dye pack normally rests. So long as the security dye pack is kept upon the magnetic keeper plate, reed switch 276 uncouples the battery pack from voltage supply conductor 158. However, when the security dye pack is lifted from the magnetic keeper plate, as when being handed to an assailant, reed switch 276 closes, thereby coupling electrical power to the circuit components.

Within the preferred embodiment of the present invention, the components not otherwise identified above have the values set forth below:

| component | value |
|---|---|
| resistors: | (in ohms) |
| 154 | 100K |
| 156 | 180K |
| 160 | 180K |
| 186 | 180K |
| 188 | 33K |
| 190 | 33K |
| 192 | 1 Meg |
| 194 | 1 Meg |
| 202 | 100K |
| 216 | 240K |
| 232 | 470K |
| 236 | 10K |
| 240 | 5.1 Meg |
| 248 | 330K |
| 258 | 330K |
| 266 | 2 Meg |
| 268 | 2 Meg |
| 270 | 150 |
| capacitors: | (in microfarads) |
| 168 | .015 |
| 170 | .033 |
| 172 | .1 |
| 180 | .022 |
| 182 | .027 |
| 184 | .1 |
| 204 | 1000 pf |
| 206 | 4.7 |
| 211 | .047 |
| 218 | .047 |
| 220 | .047 |
| 227 | .047 |
| 234 | .047 |
| 242 | 10 |
| 250 | .1 |
| 256 | .01 |
| 260 | 22 |
| 272 | .01 |
| inductors: | |
| 164/176 | 1 millihenry |
| diodes: | |
| 252/264 | DL4148 |

Those skilled in the art will now appreciate that a security dye pack has been described which is capable of being bent into a U-shape to make it more difficult for an assailant to determine the true nature of a security dye pack handed to the assailant. The novel security dye pack is adapted to discharge dye or other active chemicals in two opposing directions in order to increase the likelihood of marking stolen monies and the assailant. The configuration of the batteries enhances the flexibility of the security dye pack and facilitates its ability to bend in the middle. While the invention has been described with reference to a preferred embodiment thereof, the description is for illustrative purposes only and is not to be construed as limiting the scope of the invention. Various modifications and changes may be made by those skilled in the art without departing from the true spirit and scope of the invention as defined by the appended claims.

We claim:

1. A security dye pack disguised as a bundle of currency bills for expending dye or other active chemicals to assist in the apprehension of an assailant and in the recovery of monies stolen from a protected premises, said security dye pack comprising in combination:

a. a housing resembling a bundle of currency bills and having a hollowed inner chamber, said housing including first and second opposing ends, each of said first and second opposing ends being permeable to passage therethrough of dye or other active chemicals;

b. a first container disposed within said hollowed inner chamber and having an opening disposed proximate to and facing the first end of said housing;

c. a second container disposed within said hollowed inner chamber and having an opening disposed proximate and facing the second end of said housing;

d. first chemical means stored within said first container for being discharged through the opening of said first container and through the first end of said housing when expended to contact stolen monies and/or the assailant;

e. second chemical means stored within said second container for being discharged through the opening of said second container and through the second end of said housing when expended to contact stolen monies and/or the assailant; and f. actuating means for expending said first chemical means and said second chemical means following removal of said security dye pack from said protected premises.

2. A security dye pack as recited by claim 1 wherein said actuating means includes first and second pyrotechnic means disposed within said first and second containers, respectively, and responsive to an electrical current for causing said first and second chemical means to be discharged from said first and second containers, respectively.

3. A security dye pack as recited by claim 2 wherein said actuating means further includes electronic circuity for passing an electrical current through each of said first and second pyrotechnic means following removal of said security dye pack from said protected premises.

4. A security dye pack as recited by claim 3 including a substrate having a central portion and opposing first and second end portions, said central portion of said substrate being flexible to permit said security dye pack to bend in the middle thereof to form a U-shape, each of said first and second end portions of said substrate having a thickened portion proximate said flexible central region and a thinner flexible portion spaced apart from said flexible central region by said thickened portion, said thickened portion of said first end portion of said substrate forming a first circuit board upon which are mounted a first grouping of said electronic circuitry of said actuating means, and said thickened portion of said second end portion of said substrate forming a second circuit board upon which are mounted a second grouping of said electronic circuitry of said actuating means, said first container being secured to the thinner flexible portion of the first end portion of said substrate, and said second container being secured to the thinner flexible portion of the second end portion of said substrate.

5. A security dye pack as recited by claim 1 including a substrate having a central portion and opposing first and second end portions, said first and second containers being secured to said first and second end portions, respectively, of said substrate, said central portion of said substrate being flexible to permit said security dye pack to bend in the middle thereof to form a U-shape.

6. A security dye pack disguised as a bundle of currency bills for discharging active chemicals to assist in the apprehension of an assailant and in the recovery of monies stolen from a protected premises, said security dye pack comprising in combination:

a. a housing resembling a bundle of currency bills and having a hollowed inner chamber, said housing having a central portion and opposing first and second ends;

b. a substrate disposed within said hollowed inner chamber, said substrate having a flexible central region and opposing first and second ends;

c. electronic circuit means disposed upon said substrate outside the central region thereof for detecting removal of said security dye pack from the protected premises and generating an actuating electrical current in response thereto;

d. canister means disposed within the hollowed inner chamber of said housing proximate to said substrate outside the central region thereof and responsive to said actuating electrical current for discharging active chemicals from said housing;

e. battery means secured to said substrate outside the central region thereof for supplying electrical power to said electronic circuit means; and f. said substrate permitting said security dye pack to be bent about the flexible central region thereof into a U-shape to help avoid detection by an assailant while supporting said electronic circuit means, said canister means, and said battery means within said hollowed inner chamber.

7. A security dye pack as recited by claim 6 wherein said substrate includes a plurality of electrical conductors extending through said flexible central region thereof to effect electrical connections between said electronic circuit means, and to said battery means.

8. A security dye pack as recited by claim 7 wherein each of said first and second ends of said substrate has a thickened portion proximate said flexible central region and a thinner flexible portion spaced apart from said flexible central region by said thickened portion, said thickened portion of said first end of said substrate forming a first circuit board upon which a first grouping of electronic components of said electronic circuit means are mounted, and said thickened portion of said second end of said substrate forming a second circuit board upon which a second grouping of electronic components of said electronic circuit means are mounted.

9. A security dye pack as recited by claim 8 wherein a first canister of said canister means is secured to the thinner flexible portion of the first end of said substrate.

10. A security dye pack as recited by claim 9 wherein a second canister of said canister means is secured to the thinner flexible portion of the second end of said substrate.

11. A security dye pack as recited by claim 6 wherein said flexible central region of said substrate has a generally U-shaped loop formed therein for allowing said security dye pack to be bent into both a U-shape and an inverted U-shape.

12. A security dye pack as recited by claim 6 wherein said electronic circuit means includes at least a first electronic component secured proximate the first end of said substrate and at least electronic component secured proximate the second end of said substrate, said substrate including a plurality of electrical conductors extending through said flexible central region thereof to effect electrical connections between said first and second electronic components.

13. A security dye pack as recited by claim 6 wherein said battery means includes:

a. a plurality N of button-like batteries each having a circular periphery and a predetermined diameter D and thickness T, said plurality of batteries being arranged side-by-side in a row in abutting relationship, the circular periphery of each such battery adjoining the circular periphery of another such battery;

b. an elongated case having a chamber for supporting said plurality of batteries, said chamber having a length approximately equal to the number N of batteries multiplied by the diameter D of such batteries, a height approximately equal to diameter D, and a width approximately equal to thickness T for supporting said plurality of batteries within said chamber in the form of an elongated, thin package; and c. connector means for electrically connecting said plurality of batteries in serial connection for supplying electrical power to said electronic circuit means.

14. A security dye pack as recited by claim 13 wherein each of said batteries includes an insulated coating formed about the circular periphery thereof to insulate each such battery from the other adjoining batteries.

15. A security dye pack as recited by claim 13 wherein said canister means includes at least one canister having a predetermined length L, and wherein the length of said battery case is approximately equal to the length of said canister.

16. A security dye pack as recited by claim 15 wherein said security dye pack has a longitudinal axis, and wherein said battery case is disposed substantially adjacent and parallel to said at least one canister, and wherein the length direction of said canister and the length direction of said battery case are each oriented perpendicular to the longitudinal axis of said security dye pack.

17. A security dye pack disguised as a bundle of currency bills for expending dye or other active chemicals to assist in the apprehension of an assailant and in the recovery of monies stolen rom a protected premises, said security dye pack comprising in combination:

a. a housing resembling a bundle of currency bills and having a hollowed inner chamber, said housing being permeable to passage therethrough of dye or other active chemicals;

b. a first container including first chemical means stored therein, said first container being disposed within said hollowed inner chamber and having an opening directed in a first direction for expelling dye or other active chemicals from said housing generally in said first direction to contact stolen monies and/or the assailant;

c. a second container including second chemical means stored therein, said second container being disposed within said hollowed inner chamber and having an opening directed in a second direction for expelling dye or other active chemicals from said housing generally in said second direction, said second direction being generally opposite said first direction; and d. actuating means for expending said first chemical means and said second chemical means in generally opposing directions following removal of said security dye pack from said protected premises.

18. A security dye pack as recited by claim 17 wherein said actuating means includes first and second pyrotechnic means disposed within said first and second containers, respectively, and responsive to an electrical current for causing said first and second chemical means to be discharged from said first and second containers, respectively.

19. A security dye pack as recited by claim 18 wherein said actuating means further includes electronic circuitry for passing an electrical current through each of said first and second pyrotechnic means following removal of said security dye pack from said protected premises.

20. A security dye pack as recited by claim 19 including a substrate having a central portion and opposing first and second end portions, said central portion of said substrate being flexible to permit said security dye pack to bend in the middle thereof to form a U-shape, each of said first and second end portions of said substrate having a thickened portion proximate said flexible central regior. and a thinner flexible portion spaced apart from said flexible central region by said thickened portion, said thickened portion of said first end portion of said substrate forming a first circuit board upon which are mounted a first grouping of said electronic circuitry of said actuating means, and said thickened portion of said second end portion of said substrate forming a second circuit board upon which are mounted a second grouping of said electronic circuitry of said actuating means, said first container being secured to the thinner flexible portion of the first end portion of said substrate, and said second container being secured to the thinner flexible portion of the second end portion of said substrate.

21. A security dye pack as recited by claim 17 including a substrate having a central portion and opposing first and second end portions, said first and second containers being supported by said first and second end portions, respectively, of said substrate, said central portion of said substrate being flexible to permit said security dye pack to bend in the middle thereof to form a U-shape.

* * * * *